United States Patent [19]

Pichey

[11] 4,017,825

[45] Apr. 12, 1977

[54] INTERSECTION EMERGENCY WARNING SYSTEM

[76] Inventor: Paul J. Pichey, 5317 Curry Ford Road, Orlando, Fla. 32806

[22] Filed: Sept. 8, 1975

[21] Appl. No.: 611,436

[52] U.S. Cl. ..... 340/32; 340/224; 325/64

[51] Int. Cl.[2] ..... G08G 1/00

[58] Field of Search ..... 340/33, 34, 32

[56] References Cited

UNITED STATES PATENTS

| | | | |
|---|---|---|---|
| 2,203,871 | 6/1940 | Koch | 340/33 |
| 3,257,641 | 6/1966 | Campana | 340/33 |

*Primary Examiner*—Thomas B. Habecker
*Attorney, Agent, or Firm*—Duckworth, Hobby, Orman, Allen & Pettis

[57] ABSTRACT

An intersection emergency warning apparatus, remotely controlled from an emergency vehicle, for warning persons in proximity to an intersection as to the approach of the emergency vehicle, independent of other intersection traffic control devices. A transmitting device is mounted on the emergency vehicle for transmitting activation signals to a receiver which is mounted on a housing adjacent to the intersection. A visual warning device and an audible warning device are also attached to the housing and to the receiver. As the emergency vehicle approaches the intersection the activation signals are transmitted from the vehicle and received by the receiver located at the intersection. The activation signals activate the audible and visual warning devices, thereby alerting persons in the proximity of the intersection as to the approach of the emergency vehicle. This warning is independent of other intersection traffic control devices.

13 Claims, 3 Drawing Figures

13
28
30
26
10
24
23
42
44
56
58
36
34
32
22
40
40
22
40
38
38
80
59
M
20
86
82
84
18
50
52
88
62

INTERSECTION EMERGENCY WARNING SYSTEM

BACKGROUND OF THE INVENTION

1. Field of the Invention

This invention relates to an intersection emergency warning system and more particularly to an intersection emergency warning device which is separate from and operated independently of other intersection traffic control devices.

2. Description of the Prior Art

When emergency vehicles such as police cars, fire engines, ambulances, etc. are summoned to the scene of an emergency, these vehicles are authorized by law to safely pass through intersections in disregard of the automatic intersection traffic control devices. The emergency vehicles utilize visual and audible warning devices mounted thereon to alert nearby persons of their approach. However, due to man-made or natural obstructions near the intersection, the high ambient noise level within modern cities, and the inattention of those in the proximity of certain intersections, the emergency vehicles are often involved in vehicular accidents when other motorists negligently disregard the warning signals.

Several intersection warning systems have been devised which utilize a radio receiver to receive a signal transmitted from an emergency vehicle approaching the intersection. These warning systems often provide the capability whereby the operator of the emergency vehicle may control the intersection traffic control device—generally a traffic light—so that three of the approaching directions receive a red light at the intersection, while the roadway in the direction of travel of the emergency vehicle receives a green signal to clear stopped traffic therefrom. In the alternative, all four directions may receive red lights. The operation of the normal intersection traffic control device is captured by the presence of the emergency vehicle as previously explained and then released into normal operation upon the departure of the emergency vehicle from the proximity of the intersection. Such a system for emergency vehicle control of traffic signals is disclosed by Coll et al in U.S. Pat. No. 3,638,179. While this type of system is effective for the emergency control of traffic at congested intersections, the great complexity and concomitant expense of these systems prohibit their use in all but the most heavily traveled and dangerous intersections. A similar emergency traffic control system is disclosed by Koch in U.S. Pat. No. 2,203,871.

One variation of the radio controlled intersection emergency warning system is disclosed by Long in U.S. Pat. No. 3,550,078, in which an optical or infrared energy source is utilized by the emergency vehicle to actuate the intersection traffic control systems. Another variation is disclosed by Harsanyl in U.S. Pat. No. 3,636,507 in which a second light bulb is placed within the individual reflector assemblies of each of the lights of an intersection traffic control device. The additional light bulb is energized through a radio operated switch by an approaching emergency vehicle. The switch also interrupts the power to the normal red, green and yellow lamps.

Schwab in U.S. Pat. No. 2,963,674, discloses a remote emergency traffic control system which uses a radio transmitter means carried by an emergency vehicle for activating all of the red signal lights of the normal intersection traffic control device upon the approach of the intersection by the emergency vehicle. An auxiliary light is positioned near the intersection and is activated responsive to the signal transmitted by the emergency vehicle, thereby informing the emergency vehicle that it has control over the intersection traffic control device. When two emergency vehicles attempt to control the same traffic signal, a special circuit causes the auxiliary light to flash alternately on and off. In this manner multiple emergency vehicles attempting to cross the same intersection will be forewarned of the presence of other similarly intentioned emergency vehicles. A similar system for emergency remote control of traffic signals is disclosed by Mentzer et al in U.S. Pat. No. 3,209,325. However, the Mentzer system places the control verification light within the emergency vehicle rather than adjacent to the traffic intersection. An alternate alarm is also included to warn one emergency vehicle of an attempt by the second emergency vehicle to access and control the intersection traffic control device.

While these systems for allowing the control of intersection traffic control devices by approaching emergency vehicles are generally cost effective in densely populated cities having substantial emergency vehicle traffic, the complexity and the expense of this type of system prohibits their use in more sparsely populated areas such as the suburbs of the large cities or smaller towns. The present intersection emergency warning apparatus has been designed to fill this need. The intersection emergency warning apparatus is relatively inexpensive to produce and can be installed adjacent to normal intersection traffic control devices and operated completely independent thereof. No alterations or modifications are required to existing traffic control devices at the intersection, which further minimizes the cost of installation and operation. In addition to the normal visual warning devices utilized by the prior art inventors, the present invention utilizes an audible warning means to attract the attention of those who are inattentive to the visual intersection traffic control device.

SUMMARY OF THE INVENTION

The present invention relates to an intersection emergency warning system remotely controlled from an emergency vehicle. The intersection emergency warning system includes a transmitting means mounted on the emergency vehicle for transmitting activation signals. A receiving means is mounted on a housing which is supported adjacent to the intersection. The receiving means is used to receive the activation signals transmitted from the emergency vehicle. A visual warning means for generating a visual emergency warning signal is coupled to the receiving means and activated responsive to the activation signal therefrom. An audible warning means for generating an audible emergency warning signal is coupled to the receiving means and activated responsive to the activation signal therefrom. Both the visual warning means and the audible warning means are carried by the housing supported adjacent to the intersection.

BRIEF DESCRIPTION OF THE DRAWINGS

Other objects, features and advantages of this invention will be apparent from a study of the written description and the drawings in which.

DESCRIPTION OF THE PREFERRED EMBODIMENT

Figure 1:
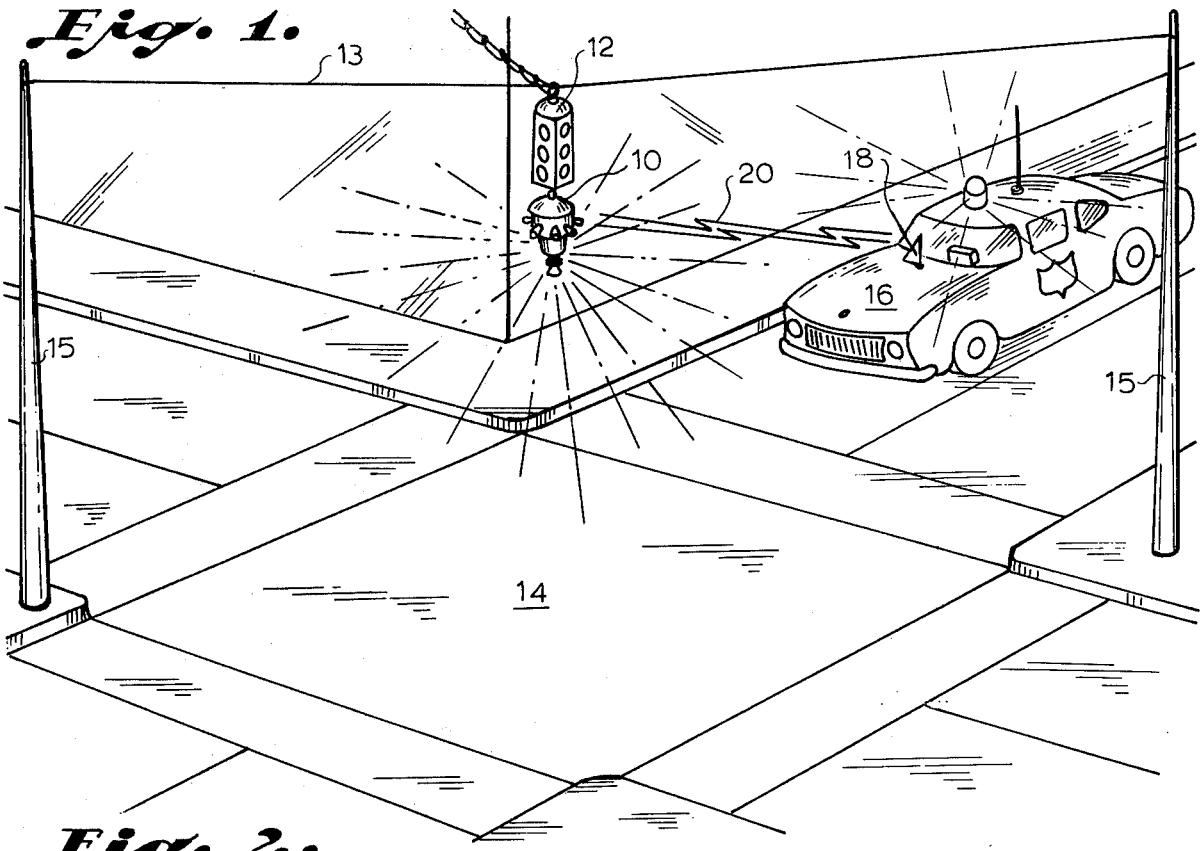
FIG. 1 shows a perspective pictorial of an emergency warning vehicle approaching an intersection having an intersection emergency warning apparatus attached to the intersection traffic control device.

An intersection emergency warning apparatus, generally referred to as 10, is shown in FIG. 1 as being suspended below a normal traffic control device 12 used to regulate the flow of traffic through an intersection 14. As an emergency vehicle 16 approaches the intersection 14, it transmits a plurality of control or activation signals 20 from a transmitting antenna 18. The intersection emergency warning apparatus 10 receives these control signals and actuates the audible and visual warning devices contained therein. It should be noted at this point that the intersection emergency warning apparatus 10 is operated completely independent of the intersection traffic control device 12. It is not necessary for the intersection emergency warning apparatus 10 to be physically attached to the intersection traffic control device 12 as shown in FIG. 1. In larger intersections having several intersection traffic control devices it may be preferable to locate one or possibly two of the intersection emergency warning devices on a common support line 13 stretching between upright support poles 15 on opposite corners of the intersection 14. The location and number of the intersection emergency warning devices 10 required at a particular intersection will be determined by a plurality of considerations, such as the number of intersection traffic control devices already present, the rate of flow of the traffic through the intersection, the visibility at the intersection, and various cost considerations.

Figure 3:
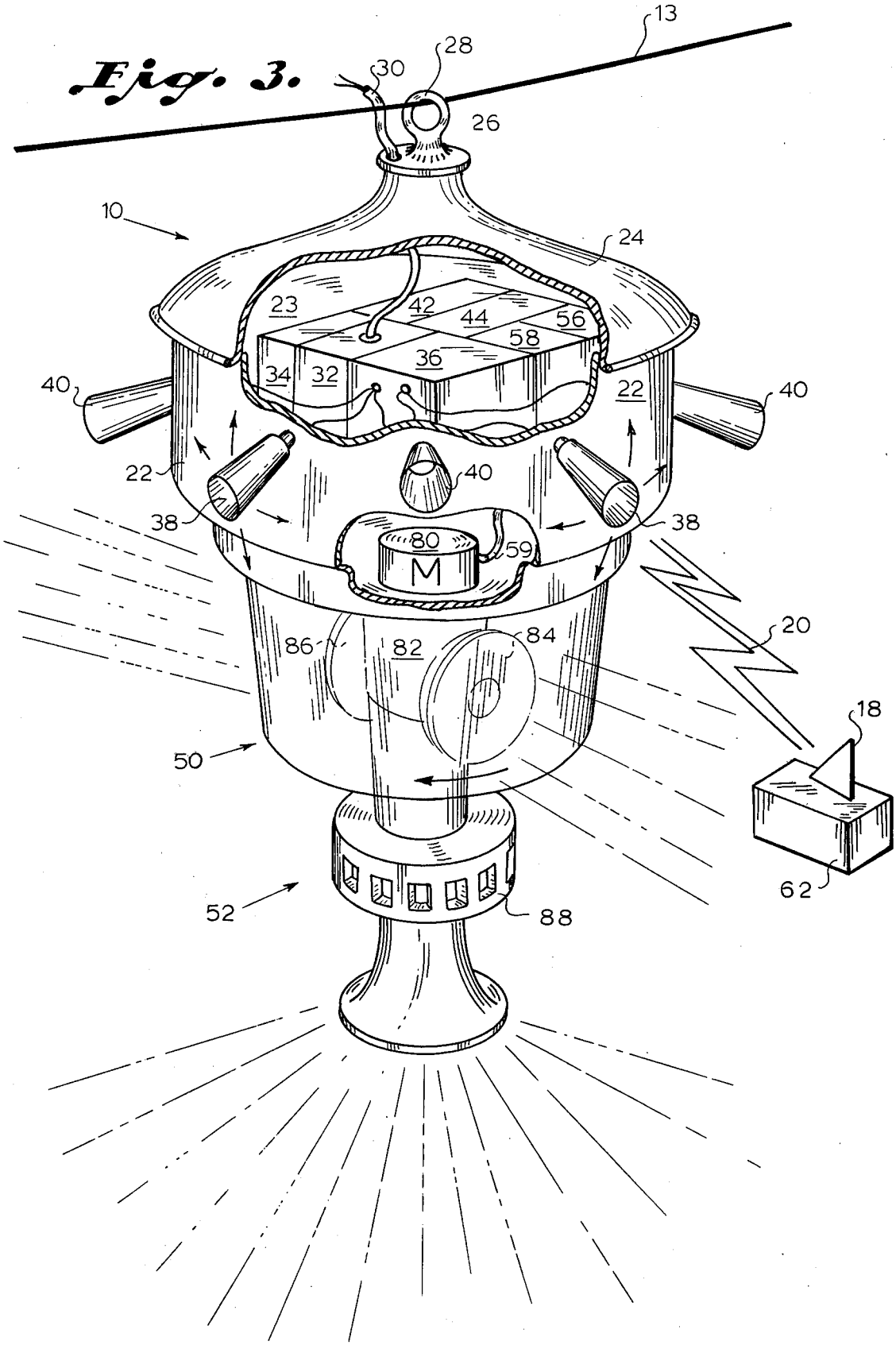
FIG. 3 is a partially sectioned perspective view of the intersection emergency warning apparatus.

Referring now to FIG. 3, the intersection emergency warning apparatus generally referred to as 10, comprises a generally cylindrical housing 22 having a generally tapered top section 24 removably attached thereto. A mounting bracket 26 is attached at the apex of the top section 24 and has a ring eyelet 28 for coupling with a support wire 13 which passes therethrough to support the intersection emergency warning apparatus 10 adjacent to the traffic intersection. A power cable 30 is attached to a source of electrical energy (not shown), nominally 115 volts 60 Hz AC power, and communicates through the mounting bracket 26 and into a generally cylindrical housing cavity 23. The power cable 30 terminates in a battery charger 32 attached to the housing 22 within the housing cavity 23.

Figure 2:
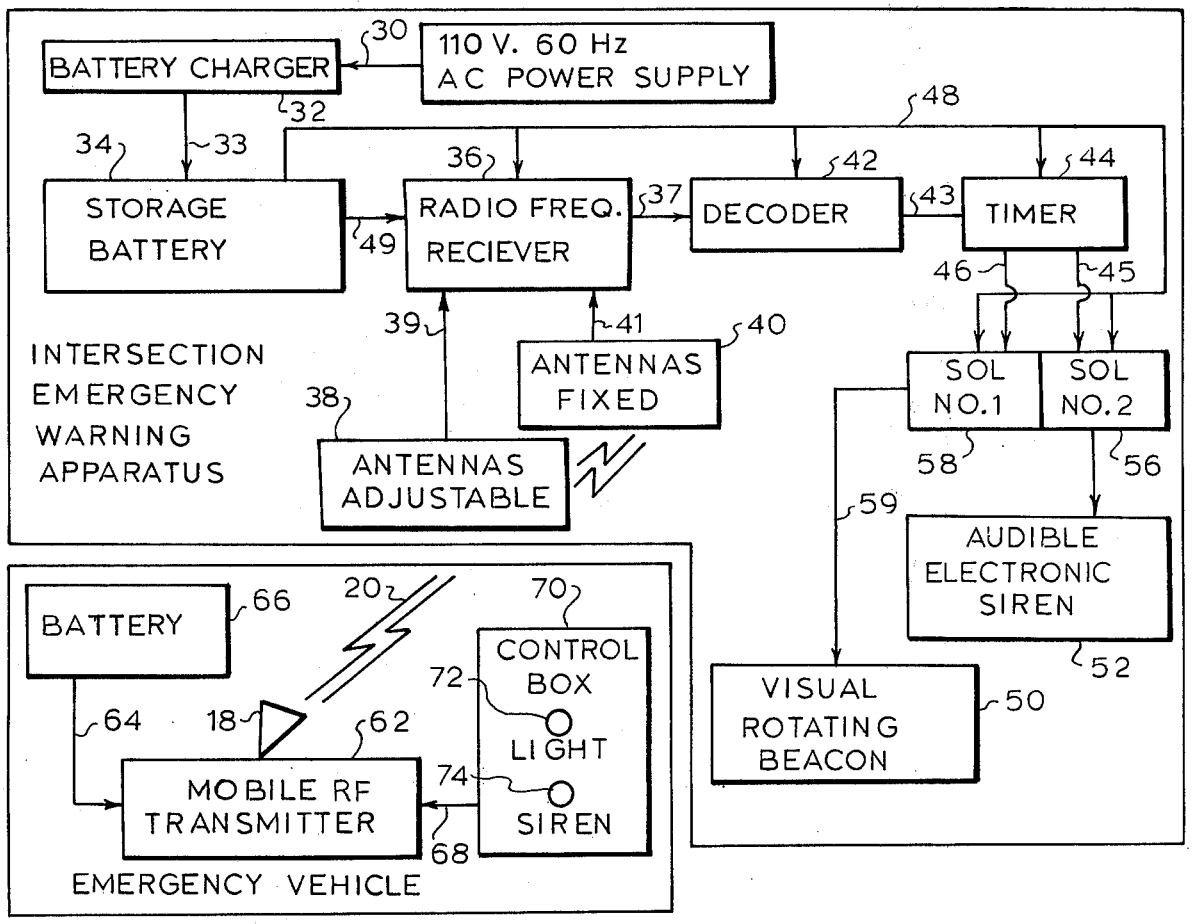
FIG. 2 shows a schematic block diagram of the intersection emergency warning system.

With reference to FIGS. 2 and 3, the DC output voltage from the battery charger 32 is coupled by a cable 33 to a storage battery 34 located within the housing cavity 23. A first output of the storage battery 34 is fed through a cable 49 to a radio frequency receiver 36. The radio frequency receiver 36, as well as the transmitter 62, should operate in the VHF or UHF radio spectrum within specific frequency bandwidths allocated for emergency public service communications by the Federal Communications Commission. Any suitable type of modulation, such as AM or FM, may be used to immunize the received signals against noise interference. In the alternative, the two control signals could be multiplied on the same radio frequency signal, with the modulation being optimized to reduce interference. The possibility of unauthorized access or interference to the intersection emergency warning apparatus may be reduced by additional incoding and decoding of the activation signals. A plurality of monodirectional receiving antennas 38 and 40 are attached to the circumferential surface of the housing 22. A first group of four adjustable monodirectional receiving antennas 38 are movably attached to the circumferential surface of the housing 22 in order that they may be aimed at non-perpendicular roadways leading into the intersection. The adjustable monodirectional receiving antennas are coupled to the receiver 36 through an antenna wiring harness 39. In a similar manner, another group of four monodirectional antennas, which are permanently mounted in fixed directions to the circumferential surface of the housing 22, are also fed to the receiver 36 through an antenna wiring harness 41. The four fixed receiving antennas are mounted at 90° angular increments around the circumferential surface of housing 22, with the four adjustable receiving antennas 38 being located equal-distant therebetween. The output of the receiver 36 is fed to a decoder 42 through a coupling line 37. The output of the decoder 42 is fed to a timer 44 through a coupling line 43. A second output from the battery 34 is coupled to the timer 44 through a power supply cable 48. A first output from the timer 44 is coupled to a first solenoid 58 through a coupling line 46. A second output of the timer 44 is coupled to a second solenoid 56 through a coupling line 45. The output of the first solenoid 58 is coupled by a cable 59 to a visual warning means 50 which comprises a rotating beacon for generating a visual emergency warning signal. The output of the second solenoid 56 is coupled by a cable 57 to an audible warning means 52, in this instance a warning siren or horn which generates an audible emergency warning signal.

A transmitting means comprising a mobile radio frequency transmitter 62 is mounted within the emergency vehicle 16 and is connected to a battery power supply 66 through a power cable 64. The radio frequency transmitter 62 is coupled by a cable 68 to a control box 70 containing a first control mode button 72 and a second control mode button 74. The output of the radio frequency transmitter 62 is coupled to a monodirectional transmitting antenna 18 which radiates the plurality of control or activation signals 20 for reception by the intersection emergency warning apparatus 10.

With continuing reference to FIG. 3, the rotating beacon 50 is attached to the lower horizontal surface of the housing 22. A motor 80 is attached to the lower surface of the housing 22 for rotating an outer sleeve 82 of the rotating beacon 50. The outer sleeve 82 contains two warning lights 84 and 86 which rotate about an axis generally coincident with the axis of the housing 22. The rotating beacon 50 is similar to the rotating beacons commonly used on emergency vehicles, wherein the high intensity warning lights 84 rotate about the center axis to radiate an apparent flashing light to those persons in the proximity to the intersection. While a rotating type beacon 50 has been illustrated, it would also be within the scope of this invention to substitute a strobe light or other visual warning means capable of generating a visual emergency warning signal. The rotating beacon 50 is surrounded by and covered with a translucent protective cover 88 which may contain pigments for filtering the light radiated from the warning lights 84 and 86. An audible warning means 89, in this instance an electronic horn or siren, is located coaxial to the rotating beacon assembly 50 and is attached to the lower portion of the housing 22. The electronic siren 88 is an electromagnetic transducer generating sound waves from the electrical energy supplied thereto, with the sound waves having periodic variations to attract the attention of those persons in proximity to the intersection. These periodic variations may be frequency variations, or amplitude variations, or both. In the alternative, a mechanical siren may be substituted for the electronic siren as shown in FIG. 3.

The operation of the intersection emergency warning system will now be described with reference to FIGS. 1, 2 and 3. As the emergency vehicle 16 approaches the intersection 14 the operator depresses either the first control mode button 72 and/or the second control mode button 74 of the control box 70, thereby activating the mobile radio frequency transmitter 62 to transmit the two activation signals 20 corresponding thereto. The two control signals 20 are received by the adjustable monodirectional receiving antennas 38 or fixed antennas 40 which are coupled to the radio frequency receiver 36. The receiver 36 demodulates the radio frequency signal and the resulting first and second control or activation signals are fed through the cable 37 to the decoder 42. The decoder 42 distinguishes between the first control signal, which is directed toward the rotating beacon 50, and the second control signal, which is directed toward the audible warning means 52. Either of the two outputs of the decoder 42 will cause the timer 44 to reset to the start mode and actuate the appropriate solenoids 56 and 58 for a predetermined period of time. The first solenoid 58 is actuated by the first control signal from the timer 44 through cable 46 and thereby feeds the power supplied by the cable 48 through the cable 59 to actuate the rotating beacon 50. In a similar manner, the second control signal from the timer 44 is coupled through the cable 45 to the second solenoid 56 which couples power from the power cable 48 through the second solenoid 56 to the electronic siren 52.

The rotating beacon 50 and electronic siren 52 are thereby actuated for a predetermined period of time (for example, a period of 1 minute), which will enable the emergency vehicle 16 to safely pass through the intersection 14 with a greatly reduced probability of being involved in a vehicular accident. At the end of this predetermined period of time the activated rotating beacon 50 and the electronic siren 52 will be automatically decoupled from the source of power by the operation of the timer 44 and the solenoids 56 and 58. The control operator may generate new first and second control signals and thereby reactuate the intersection emergency warning apparatus 10 for a second period of operation.

It should be noted that the rotating beacon 50 and the electronic siren 52 operate completely independent of each other, and therefore the control operator by depressing the appropriate control mode selectors 72 and/or 74 on the control box 70 can operate the intersection emergency warning apparatus in the following modes: (1) activation of the rotating beacon 50 only, (2) activation of the electronic siren 52 only, or (3) the activation of both the rotating beacon 50 and the electronic siren 52. It should also be noted that the intersection emergency warning system 10 can be activated independent of any temporary loss of power since all of the components therein operate from the storage battery 34 which is maintained at full charge through the operation of the battery charger 32.

It will be clear at this point that an intersection emergency warning system has been provided which overcomes some of the problems of the prior emergency traffic control devices while improving the overall costs effectiveness thereof. However, the invention is not to be construed as limited to the particular forms disclosed herein since these embodiments are to be regarded as illustrative rather than restrictive.

I claim:

1. An intersection emergency warning system which is independent of other intersection traffic control devices, and remotely controlled from an emergency vehicle, comprising in combination:

radio frequency transmitting means for mounting on an emergency vehicle for transmitting activation signals;

radio frequency receiving means for receiving said activation signals;

visual warning means for generating a visual emergency warning signal, said visual warning means being coupled to said radio frequency receiving means and activated responsive to said activation signals from said radio frequency receiving means and independent of other intersection traffic control devices, with said visual warning means comprising an illuminated rotating beacon for emitting said visual emergency warning signal in an arc sweeping the intersection as said illuminated beacon is rotated;

audible warning means for generating an audible emergency warning signal, said audible warning means being coupled to said radio frequency receiving means and activated responsive to said activation signals from said radio frequency receiving means;

a housing for carrying said radio frequency receiving means, said visual warning means and said audible warning means; and means for supporting said housing adjacent to said intersection at a position spaced from other intersection traffic control devices, whereby persons in proximity to said intersection may be warned by said visual and audible emergency warning signals as to the approach of said emergency vehicle independent of and not interacting with other intersection traffic control devices.

2. An apparatus as described in claim 1 wherein:

said activation signals comprise a first control signal and a second control signal;

said visual warning means is activated only responsive to said first control signal; and said audible warning means is activated only responsive to said second control signal.

3. An apparatus as described in claim 2 in which said transmitting means generates said first and second control signals independently, whereby said visual warning means and said audible warning means may be activated independently of each other.

4. An apparatus as described in claim 3 having timer means coupled to said visual and audible warning means for limiting the operation thereof to a predetermined period of time after said activation, said timer means being carried by said housing.

5. An apparatus as recited in claim 4 having a source of stored electrical energy for powering said receiving means, said visual warning means, said audible warning means, and said timer means, with said source of stored electrical energy having means coupled thereto for replenishing said stored electrical energy.

6. An apparatus as recited in claim 5 wherein said source of stored electrical energy is carried by said housing.

7. An apparatus as recited in claim 3 in which said transmitting means comprises:

means for generating said first control signal;

means for generating said second control signal;

a radio frequency transmitter and a transmitting antenna coupled thereto;

switch means coupled between said means for generating first and second control signals and said radio frequency transmitter for selecting among said first and second control signals to be transmitted.

8. An apparatus as recited in claim 7 wherein said receiving means comprises a radio frequency receiver and a plurality of receiving antennas coupled thereto.

9. An apparatus as recited in claim 8 wherein said plurality of receiving antennas comprises a first group of antennas fixedly attached to said housing means and a second group of antennas movably attached to said housing means.

10. An apparatus as recited in claim 8 wherein said audible warning means comprises a transducer for producing sound waves from said electrical energy, said sound waves having a plurality of frequencies within the range of human hearing for warning of the approach of said emergency vehicle.

11. An apparatus as recited in claim 8 wherein said visual warning means comprises a transducer for producing visible light from said electrical energy, said light irradiating said proximity of said intersection with periodically varying intensity for warning of the approach of said emergency vehicle.

12. An intersection emergency warning system comprising in combination:

visual warning means for generating a visual emergency warning signal, said visual warning means operated and activated independent of other intersection traffic control devices, with said visual warning means comprising a plurality of illuminating beacons circumferentially positioned about and rotatable about a central axis for emitting said visual emergency warning signal in an arc sweeping the intersection;

audible warning means for generating an audible emergency warning signal;

radio means for selectively activating said visual warning means and said audible warning means, said radio activating means comprising a radio transmitter carried by an emergency vehicle for transmitting an activating signal therefrom, and a radio receiver coupled to said audible warning means and said visual warning means to selective activation thereof responsive to receiving said activating signal;

a housing for carrying said audible warning means, said visual warning means and said activating means, with said audible warning means being attached to said housing coaxially subjacent to said visual warning means, with said visual warning means being attached to said housing coaxially subjacent to said activating means, and with a plurality of directional radio receiving antennas electrically coupled to said radio receiver and movably coupled about the circumference of said housing for being manually directed to various areas adjacent the intersection; and means for supporting said housing adjacent to said intersection at a position spaced substantially clear from other intersection traffic control devices, whereby traffic in proximity to said intersection may be warned by said visual and audible emergency warning signals as to the approach of an emergency vehicle independent of other intersection traffic control devices.

13. An apparatus as recited in claim 12 wherein said audible warning means comprises a transducer for producing sound waves having a plurality of frequencies within the range of human hearing.

* * * * *